US005252449A

United States Patent [19]

Shock

[11] Patent Number: 5,252,449

[45] Date of Patent: Oct. 12, 1993

[54] PHOTOGRAPHIC SILVER HALIDE EMULSINS WITH IMPROVED BRIGHT ROOM TOLERANCE

[75] Inventor: John R. Shock, Princeton Junction, N.J.

[73] Assignee: E. I. du Pont de Nemours and Company, Wilmington, Del.

[21] Appl. No.: 951,609

[22] Filed: Sep. 25, 1992

[51] Int. Cl.[5] ..... G03C 1/005; G03C 1/494

[52] U.S. Cl. ..... 430/566; 430/567; 430/564; 430/605

[58] Field of Search ..... 430/605, 566, 567, 564

[56] References Cited

U.S. PATENT DOCUMENTS

| | | | |
|---|---|---|---|
| 3,192,046 | 6/1965 | Kennard et al. | 96/95 |
| 3,212,899 | 10/1965 | Kennard et al. | 96/95 |
| 4,010,036 | 3/1977 | Suga et al. | 96/66.3 |
| 4,346,167 | 8/1982 | Imatomi et al. | 430/569 |
| 4,452,882 | 6/1992 | Akimura et al. | 430/441 |
| 4,617,258 | 10/1986 | Menjo et al. | 430/566 |
| 5,070,008 | 12/1991 | Maekawa et al. | 430/605 |

*Primary Examiner*—Charles L. Bowers, Jr.
*Assistant Examiner*—Geraldine Letscher

[57] ABSTRACT

A photographic silver halide emulsion comprising silver halide grains having a chloride content of at least 90 mole percent and a rhodium salt, wherein said grains have been sensitized with a black and white developing agent, provides a substantial improvement in bright room tolerance as compared to emulsions sensitized with more conventional sensitizing agents, without loss of speed or contrast. A process for improving the bright room tolerance of a photographic emulsion comprising silver halide grains having a chloride content of at least 90 mole percent and a rhodium salt comprises the step of sensitizing the grains with a black and white developing agent.

17 Claims, No Drawings

PHOTOGRAPHIC SILVER HALIDE EMULSINS WITH IMPROVED BRIGHT ROOM TOLERANCE

BACKGROUND OF THE INVENTION

1. Field of the Invention

This invention relates to photographic silver halide emulsions generally and more particularly relates to photographic silver halide emulsions having improved tolerance to bright room conditions.

2. Description of Related Art

Most conventional photographic materials are sensitive to visible light and, accordingly, must be handled under low intensity red, yellow or amber lighting, commonly referred to as "darkroom conditions," to prevent undesired exposure of the film. Also known in the art, however, are a type of photographic materials which can be handled under bright room conditions for a limited period of time without detrimental effects on the film. Such photographic materials are variously referred to in the art as "bright light films," "white light films," "daylight films," or "room light films."

Photographic materials which can be handled and processed in a bright room are specifically those which can be used in a room having illumination of at least 200 lux from a fluorescent lamp having reduced ultraviolet ray emission, or a filtered light not having the wavelength below about 420 nm as a safelight source. Typically, these photographic materials can be safely handled in bright room conditions on the order of 25 to 60 minutes, without detrimental effects on the film, such as fogging. To obtain such results, these photographic materials have greatly reduced sensitivity to visible light, that is about 1/1,000 to 1/10,000 that of ordinary darkroom photographic materials. Exposing these photographic materials requires the use of a high intensity light source rich in ultraviolet light, such as, for example a high pressure mercury lamp, a metal halide lamp, a microwave discharge type mercury non-electrode light source, and a xenon lamp. To produce the high intensity required to expose bright light films, the above-mentioned sources are broader than the point light sources used for conventional darkroom films and consequently emit more diffuse light. In order to obtain sharp character images, line images or dot images by contact exposure of such bright light silver halide photographic material with a broad high intensity source, the photographic material is required to have a high contrast photographic characteristic, i.e., a contrast value of 10 or more.

To obtain the desired high contrast, the emulsion for the photographic material typically contains silver halide grains having a high proportion of silver chloride, which have been chemically sensitized by sulfur, noble metal, or reduction sensitizers or combinations thereof. Sulfur sensitization is the most common chemical sensitizer used. However, chemical sensitization, particularly sulfur sensitization, extends the intrinsic light absorption of the photographic emulsion to light wavelengths longer than 420 nm, reducing the room light tolerance of the photographic material. Extension of the long wavelength limit of sensitivity produced by chemical sensitization is discussed in further detail in C. E. Kenneth Mees and T. H. James, *The Theory of the Photographic Process,* 3rd Edition, pages 113-116 (published by MacMillan Co., New York, 1966).

To compensate for this effect, yellow dyes having a peak absorption in the range of 400 to 550 nm are typically added to the photographic emulsion layer and/or to a layer above the emulsion to reduce sensitivity to light above 420 nm wavelength. However, dyes added for the purpose of enhancing the safelight tolerance of these photographic materials often reduce the contrast enhancement arising from chemical sensitization. Furthermore, the dyes affect light scattering properties within the photographic material in a way that reduces the capability to control line width of line images, commonly referred to as spread and choke, and to control the size of dot images, commonly referred to as dry dot etching.

Recently, the use of the lower wattage metal halide light sources and quartz iodide light sources, has become increasingly popular because of decreased cost, energy savings and improved convenience in use. These lower wattage light sources, however, have reduced ultraviolet light emission, which means that the bright light films must have a higher sensitivity for use with these light sources. In order to provide typical desired contact exposure times of about 5 to 15 seconds, photographic materials designed for use with these lower wattage light sources require about an order of magnitude higher ultraviolet light sensitivity compared to those designed for use with other high intensity light sources.

Furthermore, it is desirable to operate these lower energy light sources in a bright room, preferably, in a room where the illumination intensity is fully equivalent to the typical office environment (about 540 lux). To meet these seemingly contradictory needs, new photographic materials are required which have much higher sensitivity to ultraviolet light while simultaneously having much reduced sensitivity to light with wavelength greater than 420 nm.

SUMMARY OF THE INVENTION

In one aspect, the present invention provides a silver halide photographic emulsion having improved bright room tolerance comprising silver halide grains containing at least 90 mole percent silver chloride and a rhodium salt, wherein said silver halide grains have been sensitized with a black and white developing agent.

In another aspect, the invention provides a process for improving the bright room tolerance of a photographic emulsion containing silver halide grains comprising at least 90 mole percent silver chloride and a rhodium salt, said process comprising the step of sensitizing said grains with a black and white developing agent.

DESCRIPTION OF THE PREFERRED EMBODIMENTS

The silver halide emulsions of the present invention comprise silver halide grains comprising at least 90 mole percent silver chloride. Preferred is 100 mole percent silver chloride grains for enhanced safelight tolerance under bright room conditions. The term "bright room conditions" as used herein, means an illumination of at least 200 lux with substantially no light with a wavelength less than 420 nm. The silver halide grains are not restricted as to crystal morphology and can be produced by any of the conventional methods such as splash, single jet, double jet, or balanced double precipitation or a combination thereof as is well-known to those skilled in the art. The mean size of the silver halide grains of the present invention is generally less than 0.4 micron on an edge assuming cubic morphology for grain volume determined by electronic reduction of the grain. Grains having 0.1 to 0.2 micron edge length, with cubic morphology, and narrow size distribution (commonly called a monodisperse size distribution where 90% or more of the total grains fall within +/−40% of the mean grain size) are preferred.

To desensitize the grains and further improve handling tolerance to bright room conditions, the emulsion contains a rhodium salt preferably added during the silver halide grain formation process as is conventional in the art. Rhodium salt compounds suitable for use in this invention include but are not limited to rhodium dichloride, rhodium trichloride, potassium hexachlororhodate (III), ammonium hexachlororhodate (III), and sodium hexachlororhodate (III). The rhodium salt compounds can be added in amounts from $1\times10^{-7}$ to $1\times10^{-3}$ mole rhodium per mole silver in the emulsion.

Of particular importance to the present invention is the discovery that well known black and white photographic developing agents, when used to sensitize the silver halide grains, increase the speed and contrast of the emulsion and improve the tolerance of the film to bright room conditions. Developing agents which can be used as sensitizing agents in the present invention include developing agents conventionally known in the lithographic and printing industry for black and white photographic systems. A discussion of black and white developing agents is found in *Photographic Processing Chemistry,* 2nd Edition, by L. F. A. Mason, (John Wiley & Sons, New York), 1975, pages 14 through 29, which is incorporated herein by reference. The developing agents as used in this invention are generally described by the following formula, commonly referred to as the Pelz rule by those knowledgeable in the art:

$$\alpha-(A=B)_{n-\alpha'}$$

wherein A=carbon; B=carbon or nitrogen; $\alpha$ and $\alpha'$ are independently selected from the group of —OH, $—NH_2$, $—NHR_1$ and $—NR_1R_2$, where $R_1$ is —H, $—CH_3$, $—C_2H_5$, or $—CH_3$ and $R_2$ is $—CH_3$, $—C_2H_5$, $—C_2H_4OH$, $—C_6H_5$, or $—(CH_2CH_2)_y—NHSO_2CH_3$ where y is 1, 4, or 5; and n is zero or a whole integer. Also within the scope of the present invention are developing agents which are described by L. F. A. Mazon as exceptions to the Pelz rule, such as uric acid and 5-aminouracil, for example.

Examples of well known black and white developing agents which may be used to advantage in the invention include (1) dihydroxybenzene compounds, more particularly hydroquinone or substituted hydroquinones, such as chlorohydroquinone, bromohydroquinone, isopropylhydroquinone, toluhydroquinone, methylhydroquinone, 2,5-dimethylhydroquinone, and 2,3-dichlorohydroquinone; (2) pyrogallol; (3) gallic acid; (4) ascorbic acid-type developing agents (including derivatives and alkali salts thereof), such as D L-ascorbic acid and erythorbic acid (also known as iso-erythorbic acid); (5) pyrazolidone and derivatives thereof, such as 1-phenyl-3-pyrazolidone; (6) p-phenylenediamine derivatives, such as 4-methylaminophenol sulfate (metol); (7) aminophenols; (8) 4-amino-5-hydroxy-1-napthalene sulfonic acid and derivatives thereof; (9) uric acid; (10) 5-aminouracil; (11) hydroxylamine hydrochloride; (12) 1,2-diaminoanthraquinone; and (13) combinations thereof. Preferred developing agents used as sensitizing agents in this invention are gallic acid, pyrogallol, 4-amino-5-hydroxy-1-napthalene sulfonic acid, 2-aminophenol, uric acid, 5-aminouracil and hydroquinone compounds, most preferably hydroquinone, methyl hydroquinone and chlorohydroquinone.

The silver halide grains can be sensitized with the developing agent prior to, during, or after digestion of the emulsion or, alternatively, the developing agent can be added to an emulsion which is not digested. The developing agent can be added as a solid or as a solution in a solvent which is compatible with the emulsion, i.e., as an aqueous or alcoholic solution. The developing agent is present in the emulsion in an amount sufficient to provide the desired sensitometric characteristics to the emulsion. Generally, the amount of developing agent needed to sensitize the grains is at least $1.0\times10^{-5}$ mole developing agent per mole silver, and can be as high as 1 mole per mole silver or more. For the hydroquinone compounds, the preferred range is between $1.0\times10^{-3}$ and $5.0\times10^{-2}$ mole developing agent per mole silver.

Suitable concentration ranges for other developing agents can be determined experimentally by one having ordinary skill in the art. In particular, it is known in the art that, as a general matter, the higher the rhodium content in the grains, the more sensitizing agent is needed to obtain a given sensitometric result. Thus, for example, with a rhodium content in the range of $1\times10^{-7}$ to $1\times10^{-4}$ mole per mole silver, a suitable concentration of developing agent is in the range of $1\times10^{-5}$ to 1 mole per mole silver. On the other hand, with a rhodium concentration in the range of $1\times10^{-4}$ to $1\times10^{-3}$ mole per mole silver, the developer concentration can be in the range of $2\times10^{-3}$ to 1 mole per mole silver.

While the present invention has been described as improving the speed, contrast, and the bright room tolerance of the photographic emulsion, other advantages can be provided by the use of a developing agent as a sensitizer, such as enhanced maximum density and greater development latitude. Development latitude refers to the range of development conditions which provide suitable image reproduction.

While it is preferred that the developing agent or agents be used alone without other sensitizers for maximum bright room tolerance, the silver halide grains can also be sensitized with conventional chemical sensitizing agents such as sulfur sensitizers, selenium sensitizers, noble metal sensitizers, and reduction sensitizers. It has been found that by using the developing agents to sensitize the grains, a reduced amount of the conventional sensitizing agents is needed to achieve the desired sensitometry, which results in improved bright room tolerance. Sulfur sensitizers are described in U.S. Pat. No. 1,574,944 and include allyl isothiocyanate; allyl thiourea; thiosulfates; sodium, potassium, and ammonium thiosulfates; organic sulfides and disulfides; and the like. Examples of noble metal sensitizers include potassium chloroaurite, potassium aurithiocyanate, potassium chloroaurate, potassium chloroplatinate, ammonium chloropalladate, sodium chloropaladite, and the like. Examples of selenium sensitizers include selenurea, and the like. Examples of reduction sensitizers include stanneous chloride, triethylenetetramine, formamidinesulfinic acid, and the like.

In a preferred embodiment, the emulsion will also contain a stabilizing agent. Stabilizing agents are known in the art as agents that stabilize the silver halide emulsion against sensitometric changes, such as fog increase, speed change and gradient loss, during storage. When used in the emulsions of the present invention, however, the stabilizing agents also serve to enhance the sensitizing effect of the developing agents. Stabilizing agents suitable for use in the invention include azaindene compounds and their salts, such as for example, tetraazaindene compounds; and azole compounds, such as for example, nitrobenzotriazoles, benzotriazoles, nitroindazoles, nitrobenzimidazoles, mercaptothiazoles, mercaptotetrazoles, nitromidazoles, and the like; sulfinic acids, benzene sulphinic acid being an example; substituted pyrimidines, 2-mercapto-4-hydroxypyrimidine being an example, and metal compounds such as water soluble salts of mercury, cadmium, zinc, manganese, and gold. Preferred stabilizers are 4-hydroxy-6-methyl-1,3,3a,7-tetraazaindene used alone or in combination with benzotriazole and/or mercuric chloride.

While filter dyes are not required to obtain the desired bright room tolerance in the emulsions, they may be used to further improve that property, if desired. More preferably, filter dyes may be used in the emulsion to adjust the exposure latitude and speed of the photographic element. Exposure latitude refers to the range of exposures which provide faithful image reproduction during contact exposure. The filter dye may be incorporated in the silver halide emulsion or it may be present in another layer of the photographic element. Suitable dyes normally have the maximum absorption peak between 400 and 550 nm and a tail or secondary absorption peak below 400 nm. For example, azo, oxonol, hemioxonol, cyanine, mericyanine dyes and the like, can be used.

The preferred binder or protective colloid for the silver halide emulsion of the present invention is gelatin, but other hydrophilic colloids, such as gelatin derivatives (e.g. phthalated gelatin and grafted polymers with gelatin), cellulose derivatives (e.g. carboxymethyl cellulose), polyvinylpyrrolidone and other water soluble polymers, synthetic binders such as polyvinyl alcohol, saccahrose derivatives, starch derivatives, and combinations thereof can be used.

To improve the dimension stability of the photographic element, the emulsion may contain dispersions of synthetic polymer latices such as polymethyl acrylates, polyethyl acrylates, and the like, used alone or in combination, as is well known in the art.

The silver halide emulsion of the present invention may include one or a combination of the conventional hardeners such as chrome alum, formaldehyde, dimethylol urea, mucochloric acid, glyoxal, glutaraldehyde, etc. Other conventional emulsion adjuvants that may be added comprise matting agents, wetting and coating aids, surfactants, image color modifiers, and covering power adjuvants among others.

After the emulsion is prepared, it may be coated in one or more layers on any of the conventional supports for silver halide photographic films or papers. For photographic elements used in the graphic arts industry, for example, it is conventional to use dimensionally stable polyethylene terephthalate which may be suitably subbed with conventional resin and/or gelatin subbing layers, for example, in order to be receptive to the aqueous emulsion. Additional layers may also be coated on the support, such as antistatic layers, backing layers, anti-curl layers, antihalation layers, etc. as is well known to those skilled in the art. A thin hardened gelatin layer may be coated over the emulsion to serve as a protective layer.

The photographic elements containing the emulsions of this invention may be developed in any conventional manner suitable for the particular application. It is preferred to develop the photographic material with rapid access processing, using conventional rapid access developers. Rapid access processing is understood by one skilled in the art as high energy processing primarily in order to reduce throughput time in the processor. However, the photographic material can also be processed in litho developer and other developers conventional in the printing industry. Development time and temperature is not limited. The photographic element can be fixed, washed, and dried by conventional methods.

Similarly, photographic elements containing the emulsion of this invention may be exposed with any of the conventional high intensity or low wattage light sources for bright light films referred to above, but are particularly well suited for exposure by a low wattage quartz iodide light source.

The present invention will now be further illustrated by the following examples.

EXAMPLES

The following developing agents were used to sensitize the grains in the examples.

A-1 = Hydroquinone
A-2 = Chlorohydroquinone
A-3 = Erythorbic Acid
A-4 = 4-methylaminophenol sulfate (Metol)
A-5 = 1-phenyl-3-pyrazolidone (Phenidone)
A-6 = Pyrogallol
A-7 = Gallic Acid
A-8 = 4-amino-5-hydroxy-1-napthalene sulfonic acid
A-9 = Methyl hydroquinone
A-10 = 2-aminophenol
A-11 = Uric acid
A-12 = 1,2-diaminoanthraquinone
A-13 = Hydroxylamine hydrochloride
A-14 = 5-aminouracil

EXAMPLE 1

Silver halide grains having a 100 mole % silver chloride composition and containing $8.4\times10^{-6}$ mole rhodium/mole silver were precipitated using the balanced double jet precipitation process. Rhodium doping of the grain was accomplished by adding $Na_3RhCl_6$ to an aqueous solution of NaCl. The rhodium containing NaCl solution was added simultaneously with an aqueous silver nitrate solution to a gelatin-containing aqueous heel solution. The pAg in the heel was maintained constant by adjusting the halide solution flow rate.

After a flocculation and desalting process, the grains were dispersed in a bulking amount of gelatin and the emulsion was split into two parts. To the Control 1 sample, polyethyl acrylate latex, sodium nonyl phenoxyethoxy sulfate surfactant, and formaldehyde hardener were added after a 10 minute digestion period. The Example 1 sample was treated identically to the Control 1 sample except solid hydroquinone in the amount shown in Table 1 was added just prior to the digestion period.

The thus prepared emulsions were coated on polyethylene terephthalate supports having normal resin and gel sub-layers at a silver coating weight of 3.9 g/m$^2$. A thin layer of gelatin (0.5 g/m$^2$) was coated over each emulsion layer as a protective overcoat.

Strips from the coated and dried films were exposed through a continuous wedge having a density range of 0 to 1.5 by a 1000 Watt quartz iodide light source and developed for 20 seconds in Du Pont CUFD developer at 46° C. and fixed with Du Pont DFL fixer using a Du Pont Cronalith® RA II processor. Sensitometry was computed in the conventional manner. The contrast value was determined as the gradient (slope) of the characteristic curve between 0.35 and 1.50 densities above base plus fog. Speed was reported as an arithmetic expression of relative log exposure at an optical density of 0.3 above base plus fog with the Control 1 sample taken as 100.

The coated and dried films were tested for safelight sensitivity using fluorescent lighting (GTE 40W by Sylvania) with Illumination Technology Super White Sleeves having UV cut off of 420 nm and 540 foot lux illumination measured at the test film plane. The films were exposed to the fluorescent lighting for 30 minutes and 60 minutes, developed as described above and evaluated for the increase in developed density over base plus fog. The density was measured on a McBeth densitometer, model TD-901. The sensitometric results and safelight tolerance (reported as the density increase over base plus fog) of the coated films are shown in Table 1.

TABLE 1

| | SENSITIZING AGENT | | | | SAFELIGHT TOLERANCE | | |
|---|---|---|---|---|---|---|---|
| SAMPLE | COMPOUND | AMOUNT (mole/mole Silver) | (a) RELATIVE SPEED | CONTRAST VALUE | Dmax | DENSITY AFTER 30 min. | DENSITY AFTER 60 min. |
| Control 1 | — | — | 100 | — | 1.3 | 0.000 | 0.002 |
| Example 1 | A-1 | $2.4 \times 10^{-2}$ | 203 | 10.3 | 6.2 | 0.002 | 0.007 |

Example 1, which contains hydroquinone, has substantially higher speed, contrast, and Dmax, compared to the primitive emulsion coating, Control 1. Thus, the hydroquinone in Example 1 produces the same photographic response normally associated with a sensitizing agent. The safelight tolerance to bright room illumination, however, remains virtually unchanged from that of the primitive emulsion, contrary to the effects normally observed with conventional sensitizing agents.

COMPARATIVE EXAMPLES 1A AND 2A 100 mole % silver chloride grains made in the same manner and with the same level of rhodium as Example 1, were split into portions after dispersion in a bulking amount of gelatin. To each portion was added 4-hydroxy-6-methyl-1,3,3A,7-tetraazaindene prior to a 10 minute digestion, after which were added benzotriazole, mercuric chloride, and the same latex, surfactant, and hardening agent as in Example 1. Control 2 contained no other additives. To the portions designated Comparative Examples 1A and 2A, sodium thiosulfate was added after the tetraazaindene addition and just before digestion. The samples were coated and evaluated sensitometrically and for safelight tolerance in the manner described in Example 1. In Table 2, speed is reported relative to the Control 1 sample taken as 100.

The results of Comparative Examples 1A and 2A versus Control 2 shown in Table 2 demonstrate that the sulfur sensitizer, sodium thiosulfate, substantially increases speed and contrast while substantially decreasing the safelight tolerance to bright room illumination.

EXAMPLES 2 THROUGH 30

The following Examples were prepared by replacing the sodium thiosulfate from Comparative Examples 1A and 2A with the sensitizing agents and amounts identified in Table 2.

TABLE 2

| | SENSITIZING AGENT | | | | SAFELIGHT TOLERANCE | |
|---|---|---|---|---|---|---|
| SAMPLE | COMPOUND | AMOUNT (mole/mole Silver) | (a) RELATIVE SPEED | CONTRAST VALUE | DENSITY AFTER 30 min. | DENSITY AFTER 60 min. |
| Control 2 | — | — | 144 | 7.4 | 0.001 | 0.005 |
| Comparative Example 1A | $Na_2S_2O_3$ | $6.0 \times 10^{-5}$ | 217 | 9.7 | 3.70 | 7.00 |
| Comparative Example 2A | $Na_2S_2O_3$ | $1.2 \times 10^{-4}$ | 246 | 10.7 | 7.00 | 7.00 |
| Example 2 | A-1 | $1.2 \times 10^{-4}$ | 192 | 9.4 | 0.000 | 0.006 |
| Example 3 | A-1 | $1.2 \times 10^{-3}$ | 256 | 11.4 | 0.001 | 0.006 |
| Example 4 | A-1 | $1.2 \times 10^{-2}$ | 250 | 11.1 | 0.003 | 0.011 |
| Example 5 | A-2 | $1.2 \times 10^{-3}$ | 217 | 9.8 | 0.000 | 0.004 |
| Example 6 | A-2 | $1.2 \times 10^{-2}$ | 250 | 11.4 | 0.002 | 0.006 |
| Example 7 | A-3 | $1.2 \times 10^{-3}$ | 215 | 9.0 | 0.003 | 0.011 |
| Example 8 | A-3 | $1.2 \times 10^{-2}$ | 239 | 10.7 | 0.008 | 0.045 |
| Example 9 | A-4 | $1.2 \times 10^{-3}$ | 239 | 10.0 | 0.002 | 0.004 |
| Example 10 | A-4 | $1.2 \times 10^{-2}$ | 180 | 8.8 | 0.002 | 0.009 |
| Example 11 | A-5 | $1.2 \times 10^{-3}$ | 213 | 8.5 | 0.000 | 0.006 |
| Example 12 | A-5 | $1.2 \times 10^{-2}$ | 235 | 9.5 | 0.003 | 0.006 |
| Example 13 | A-6 | $1.2 \times 10^{-3}$ | 243 | 10.3 | 0.001 | 0.008 |
| Example 14 | A-6 | $1.2 \times 10^{-2}$ | 256 | 11.1 | 0.001 | 0.008 |
| Example 15 | A-7 | $1.2 \times 10^{-3}$ | 230 | 10.1 | 0.001 | 0.006 |
| Example 16 | A-7 | $1.2 \times 10^{-2}$ | 248 | 11.7 | 0.002 | 0.007 |
| Example 17 | A-8 | $1.2 \times 10^{-3}$ | 182 | 9.5 | 0.002 | 0.004 |
| Example 18 | A-8 | $1.2 \times 10^{-2}$ | 211 | 10.5 | 0.002 | 0.007 |
| Example 19 | A-9 | $1.2 \times 10^{-3}$ | 233 | 10.6 | 0.002 | 0.009 |
| Example 20 | A-9 | $1.2 \times 10^{-2}$ | 246 | 10.1 | 0.005 | 0.18 |
| Example 21 | A-10 | $1.2 \times 10^{-3}$ | 229 | 10.3 | 0.001 | 0.002 |
| Example 22 | A-10 | $1.2 \times 10^{-2}$ | 232 | 9.6 | 0.002 | 0.004 |
| Example 23 | A-11 | $1.2 \times 10^{-3}$ | 186 | 10.0 | 0.001 | 0.002 |
| Example 24 | A-11 | $1.2 \times 10^{-2}$ | 195 | 10.6 | 0.001 | 0.004 |
| Example 25 | A-12 | $1.2 \times 10^{-3}$ | 181 | 7.5 | 0.000 | 0.002 |

TABLE 2-continued

| SAMPLE | SENSITIZING AGENT COMPOUND | AMOUNT (mole/mole Silver) | (a) RELATIVE SPEED | CONTRAST VALUE | SAFELIGHT TOLERANCE DENSITY AFTER 30 min. | DENSITY AFTER 60 min. |
|---|---|---|---|---|---|---|
| Example 26 | A-12 | $1.2 \times 10^{-2}$ | 190 | 9.5 | 0.001 | 0.001 |
| Example 27 | A-13 | $1.2 \times 10^{-3}$ | 116 | 7.2 | 0.001 | 0.003 |
| Example 28 | A-13 | $1.2 \times 10^{-2}$ | 134 | 8.5 | 0.001 | 0.001 |
| Example 29 | A-14 | $1.2 \times 10^{-3}$ | 233 | 10.0 | 0.000 | 0.003 |
| Example 30 | A-14 | $1.2 \times 10^{-2}$ | 257 | 11.2 | 0.002 | 0.006 |

Comparing the results in Table 2 for the films which contain developing agents as sensitizers (Examples 2 through 30) to the sulfur sensitized films containing the developing agents provide equivalent or substantially equivalent speed and contrast to the sulfur sensitized films, while providing greatly improved tolerance to bright room conditions. Furthermore, comparison of Example 4 in Table 4 to Example 1 in Table 1, shows that the addition of the stabilizing agents (4-hydroxy-6-methyl-1,3,3A,7-tetraazaindene, benzotriazole, and mercuric chloride) enhances the increase in speed and contrast resulting from the sensitization while leaving the safelight tolerance to bright room illumination essentially unchanged. Thus, the stabilizers further improve the sensitizing effect in achieving sufficient contrast for sharp images.

What is claimed is:

1. A photographic silver halide emulsion having improved bright room tolerance comprising silver halide grains having a chloride content of at least 90 mole percent and a rhodium salt, wherein said silver halide grains have been sensitized with a black and white developing agent.

2. The emulsion of claim 1, further comprising at least one stabilizing agent.

3. The emulsion of claim 2, wherein the stabilizing agent comprises an azaindene compound or a salt thereof.

4. The emulsion of claim 2, wherein the stabilizing agent comprises benzotriazole or a derivative thereof.

5. The emulsion of claim 2, wherein the stabilizing agent comprises a water soluble salt of mercury, cadmium, zinc, manganese, or gold.

6. The emulsion of claim 1, wherein the developing agent is present in an amount between $1.0\times10^{-5}$ and 1 mole developing agent per mole silver.

7. The emulsion of claim 6, wherein the rhodium salt is present in an amount between $1\times10^{-7}$ and $1\times10^{-4}$ mole rhodium per mole silver.

8. The emulsion of claim 1, wherein the said rhodium salt is present in an amount between $1\times10^{-7}$ and $1\times10^{-3}$ mole rhodium per mole silver.

9. The emulsion of claim 1, wherein the rhodium salt is present in an amount between $1\times10^{-4}$ and $1\times10^{-3}$ mole rhodium per mole silver and wherein the developing agent is present in an amount between $2\times10^{-3}$ and 1 mole per mole silver.

10. The emulsion of claim 1, wherein said emulsion is coated on a support.

11. The emulsion of claim 1, wherein said developing agent is selected from the group of hydroquinone, gallic acid, methylhydroquinone, chlorohydroquinone, erythorbic acid, 4-methylaminophenol sulfate, 1-phenyl-3-pyrazolidone, pyrogallol, 2-aminophenol, 4-amino-5-hydroxy-napthalene sulfonic acid, uric acid, 5-aminouracil, hydroxylamine hydrochloride, 1,2-diaminoanthraquinone, and combinations thereof.

12. A process for improving the bright light tolerance of a photographic emulsion containing silver halide grains having a chloride content of at least 90 mole percent and a rhodium salt, said process comprising the step of sensitizing said grains with a black and white developing agent.

13. The process of claim 12, wherein the sensitizing step comprises adding said developing agent in an amount between $1.0\times10^{-5}$ and 1 mole developing agent per mole silver.

14. The process of claim 12, wherein said rhodium salt in an amount between $1\times10^{-7}$ and $1\times10^{-3}$ mole rhodium per mole silver.

15. The process of claim 12, wherein said rhodium salt is present in an amount between $1\times10^{-4}$ and $1\times10^{-3}$ mole rhodium per mole silver and wherein the developing agent is present in an amount between $2\times10^{-3}$ and 1 mole per mole silver.

16. The process of claim 12, wherein said rhodium salt is present in an amount between $1\times10^{-7}$ and $1\times10^{-4}$ mole rhodium per mole silver and wherein the developing agent is present in an amount between $1.0\times10^{-5}$ and 1 mole developing agent per mole silver.

17. The process of claim 12, wherein said developing agent is selected from the group of hydroquinone, gallic acid, methylhydroquinone, chlorohydroquinone, erythorbic acid, 4-methylaminophenol sulfate, 1-phenyl-3-pyrazolidone, pyrogallol, 2-aminophenol, 4-amino-5-hydroxy-napthalene sulfonic acid, uric acid, 5-aminouracil, hydroxylamine hydrochloride, 1,2-diaminoanthraquinone, and combinations thereof.

* * * * *